US006175985B1

(12) United States Patent
Chambers et al.

(10) Patent No.: US 6,175,985 B1
(45) Date of Patent: Jan. 23, 2001

(54) PAINT ROLLER AND METHOD OF MAKING SAME USING CONTINUOUS YARN TUFTSTRINGS

(75) Inventors: Jeffrey Allen Chambers; Gregory Weeks, both of Hockessin, DE (US)

(73) Assignee: E. I. Du Pont de Nemours & Company, Wilmington, DE (US)

( * ) Notice: Under 35 U.S.C. 154(b), the term of this patent shall be extended for 0 days.

(21) Appl. No.: 09/185,543

(22) Filed: Nov. 4, 1998

(51) Int. Cl.[7] ..... B05C 17/02

(52) U.S. Cl. ..... 15/230.12; 15/230.11; 29/895.211; 492/13

(58) Field of Search ..... 492/13; 15/230, 15/230.11, 230.12, 230.13; 29/895.211; 428/85, 92, 93, 95, 96

(56) References Cited

U.S. PATENT DOCUMENTS 1,287,121 * 12/1918 Skau .
1,887,477 * 11/1932 Slater .
2,545,700 * 3/1951 MacKey .
3,726,751 4/1973 Casadevall .
4,404,703 * 9/1983 Woodall et al. .
4,642,831 * 2/1987 Roth .
4,835,807 * 6/1989 Swift .
5,128,725 * 7/1992 Frankel .
5,206,968 * 5/1993 Bower et al. .
5,397,414 * 3/1995 Garcia et al. .
5,470,629 * 11/1995 Mokhtar et al. .
5,694,688 * 12/1997 Musch et al. .

FOREIGN PATENT DOCUMENTS

0744275A2 11/1996 (EP) .

* cited by examiner

*Primary Examiner*—Deborah Jones
*Assistant Examiner*—Jennifer McNeil
(74) *Attorney, Agent, or Firm*—Morgan & Finnegan, L.L.P.

(57) ABSTRACT

A paint roller includes a core tube having first and second opposite axial ends. At least one tuftstring is spirally wrapped around the core tube and adhesively or otherwise bound to the core tube.

12 Claims, 6 Drawing Sheets

PAINT ROLLER AND METHOD OF MAKING SAME USING CONTINUOUS YARN TUFTSTRINGS

BACKGROUND OF THE INVENTION

The present invention relates generally to paint rollers and, more particularly, to a paint roller having a pile covering made of continuous yarn tuftstrings.

It is known in the art to form paint rollers by winding strips of pile material around a plastic or cardboard tube. An adhesive is used to bind the strips to the tube. One example of such a paint roller is found in U.S. Pat. No. 5,397,414 to Garcia et al. In Garcia et al., the strips have pile material upstanding from a fabric base, and the fabric base is adhesively bonded to the tube using a thermosetting adhesive which is applied during winding of the strip.

U.S. Pat. No. 5,470,629 to Mokhtar et al. describes a new method of making pile "tuftstrings." Briefly, each tuftstring is made by wrapping yarn around a mandrel on which a support strand is translated. As the support strand moves, it transports "wraps" of yarn to an ultrasonic welder which connects the wraps to the support strand. The bonded wraps are further transported to a slitter station which cuts the wraps and thereby forms the tuftstring. The tuftstring includes two rows of upstanding legs or tufts which are attached at their bases to the support strand.

The yarn of Mokhtar et al. is a multifilament, crimped, bulky yarn that is made preferably of a thermoplastic polymer, such as nylon, polypropylene, etc. The support strand is likewise preferably a thermoplastic polymer so that, when passed under the ultrasonic welder, the yarn and support strand melt to form a bond therebetween. The tuftstrings of Mokhtar et al. represent an improvement in the methods of making tufted articles.

The present invention represents an improvement in the art of making paint rollers, using the tuftstrings of Mokhtar et al.

SUMMARY OF THE INVENTION

An object of the present invention is to provide a paint roller that is relatively easy to assemble, and thus, cost effective to produce.

Another object of the present invention is to provide means to expand roller design beyond the range possible with current techniques.

Another object of the present invention is to provide a paint roller in which individual tuftstrings are spirally wrapped around a core, such that tuftstrings having different properties can be simultaneous wrapped to achieve a desired physical or aesthetic effect.

These and other objects are met by providing a paint roller which includes a core tube with an outer surface, at least one tuftstring spirally and continuously wrapped around the roller, and a bonding agent disposed between the at least one tuftstring and the outer surface of the core tube.

Other objects and features of the invention will become more apparent from the following detailed description when taken in conjunction with the illustrative embodiments in the accompanying drawings.

DETAILED DESCRIPTION OF THE PREFERRED EMBODIMENTS

Figure 1:
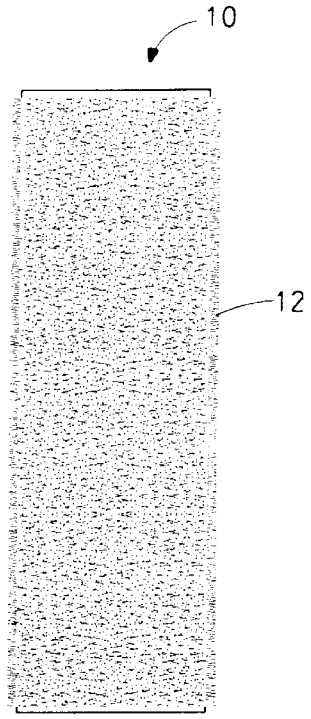
FIG. 1 is a side elevational view of a paint roller according to the present invention.
Figure 2:
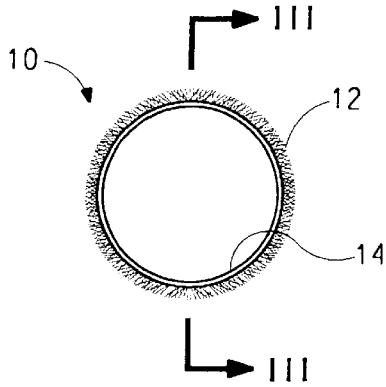
FIG. 2 is an end view of the paint roller of FIG. 1.
Figure 3:
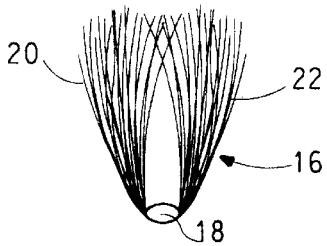
FIG. 3 is an end view of a tuftstring used to make the pile covering of the paint roller of FIG. 1.

Referring to FIGS. 1–3, a paint roller 10 has a pile covering 12 mounted on a hollow core 14. The hollow core 14 can have any suitable shape, such as cylindrical or oval, depending upon the application. The pile covering 12 is made of at least one tuftstring 16 having a support strand 18 and a plurality of U-shaped bundles of yarn connected to the support strand 18, each bundle forming a pair of upstanding legs or tufts 20 and 22.

The pile covering 12 is formed by wrapping one or more tuftstrings 16 spirally and continuously around the outer surface of the core 14. The support strand 18 is fixedly connected to the core 14 by any suitable bonding means, including an adhesive binder applied to the outer surface of the core 14 immediately prior to the wrapping step. Chemical or thermal binding processes could be also be employed, as well as mechanical binders, such as anchors disposed at opposite ends of the core 14. The core 14 can comprise paper and resin which have adhesive applied thereto. The core 14 can also include spiral windings of paper impregnated with resin to which adhesive and fabrics are applied to form a continuous profile.

Figure 5:
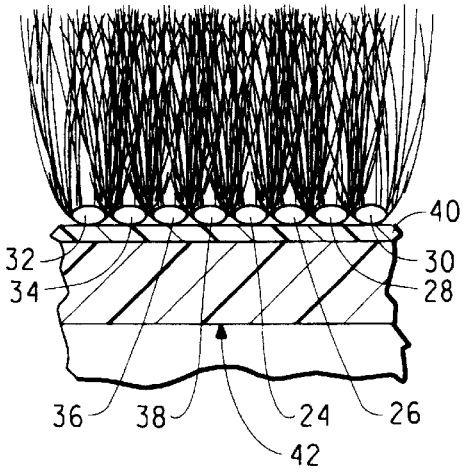
FIG. 5 is an enlarged, partial vertical sectional view of another embodiment of a paint roller, similar to the embodiment of FIG. 1, but with the tuftstrings mounted on a backing tape.
Figure 6:
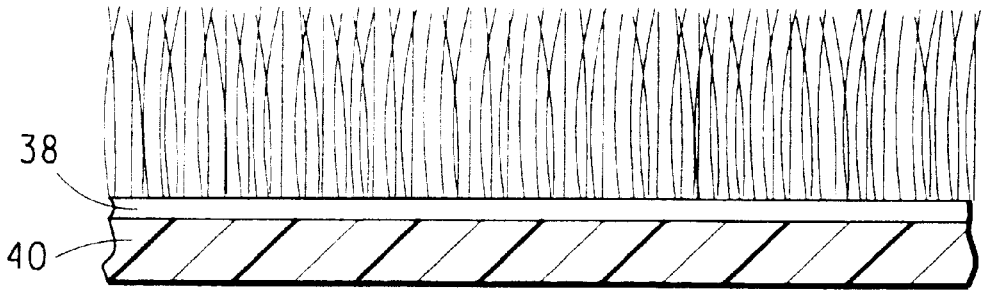
FIG. 6 is a side elevational view of a length of backing tape with tuftstrings attached to form a pile tape.
Figure 7:
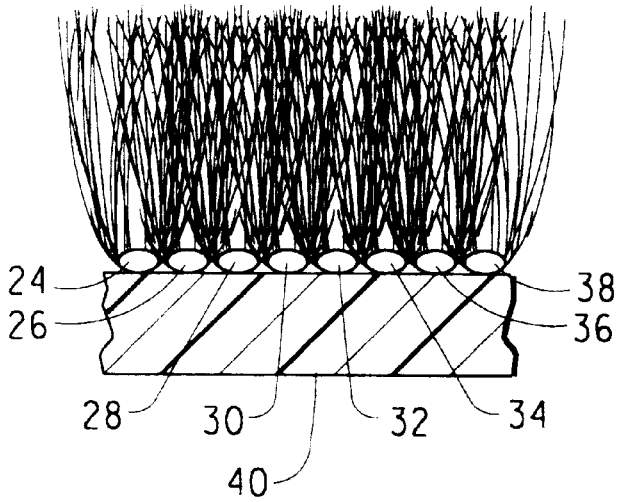
FIG. 7 is an end view of the pile tape of FIG. 6.

Referring to FIGS. 5–7, a plurality of tuftstrings 24, 26, 28, 30, etc., 32, 34, 36 and 38 are connected to a backing tape 40 by ultrasonic welding or by hot melt adhesives disposed between the support strand of each tuftstring and the tape. When spirally wrapped around a core 42, as seen in FIG. 5, the tape 40 will have abutting or adjacent wraps on which the tuftstrings from opposite sides of the tape will be adjacent to each other, i.e., such that tuftstrings 32, 34, 36 and 38 are adjacent tuftstrings 24, 26, 28 and 30.

Figure 8:
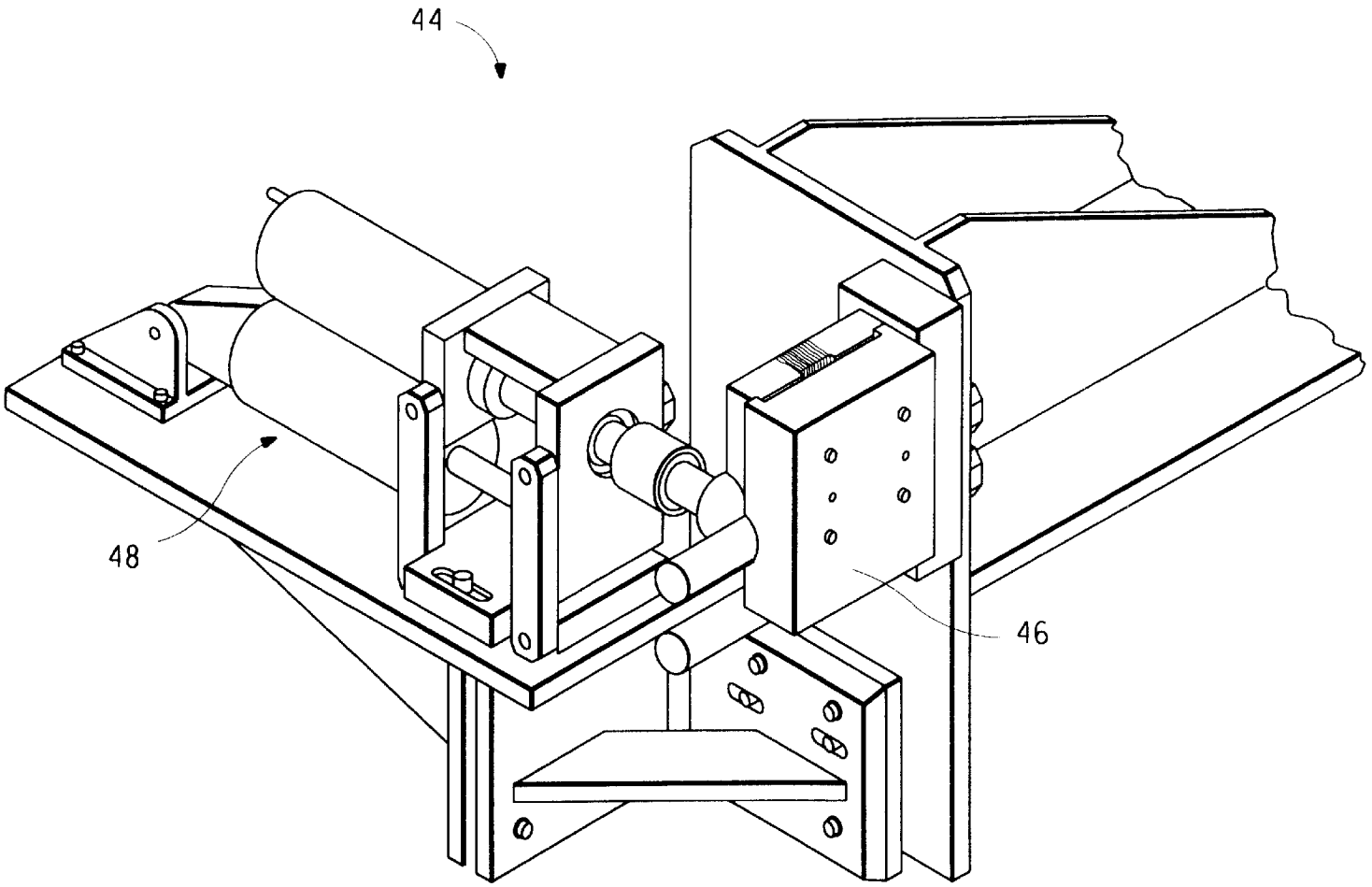
FIG. 8 is a partial perspective view of an apparatus for making tufted tape for use in making paint rollers according to one embodiment of the present invention.
Figure 9:
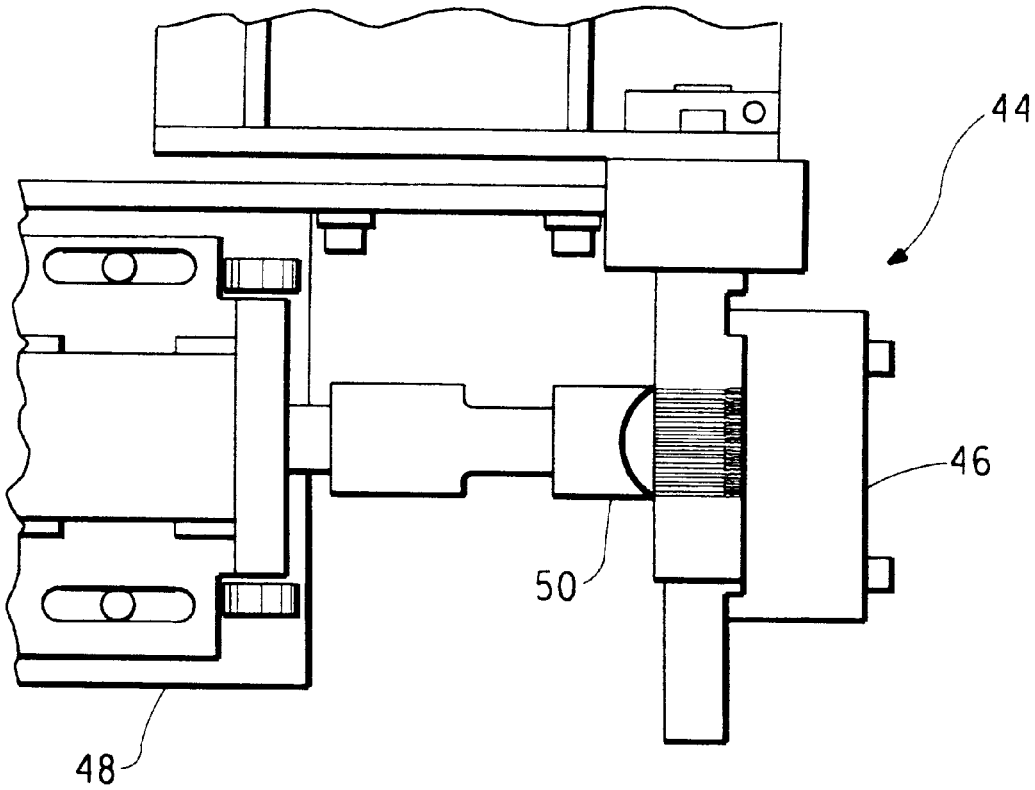
FIG. 9 is a partial top view of the apparatus of FIG. 8.
Figure 10:
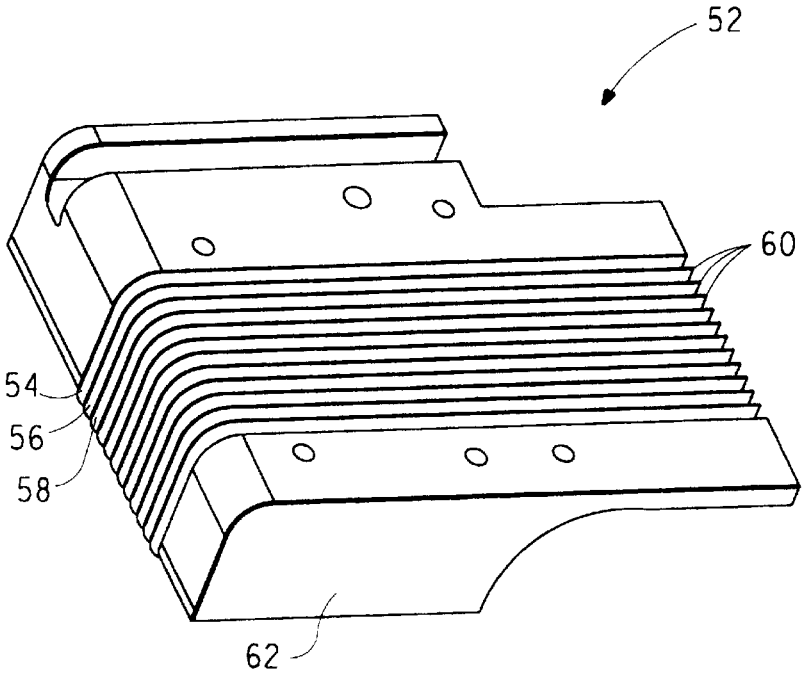
FIG. 10 is a top perspective view of a guide block used in the guide mechanism portion of the apparatus of FIGS. 8 and 9.

As seen in FIGS. 8 and 9, an apparatus 44 for forming a tufted tape includes a guide mechanism 46 which guides a plurality of individual tuftstrings into contact with a support tape. An ultrasonic welding station 48 includes an ultrasonic horn 50 which is powered sufficiently to impart melting of the thermoplastic materials which comprise either the yarns or support strands, or both, of the multiple tuftstrings.

Figure 11:
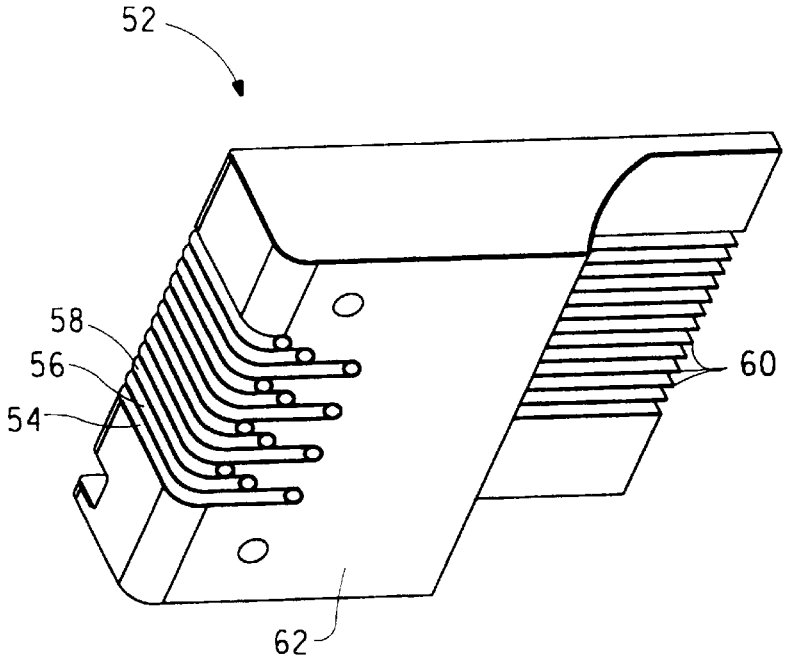
FIG. 11 is a bottom perspective view of the guide block of FIG. 10.
Figure 12:
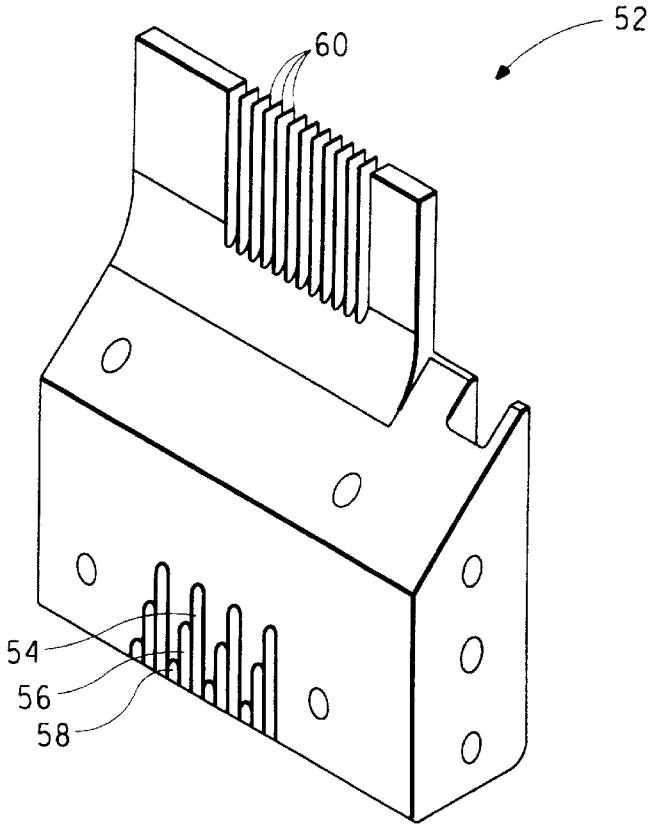
FIG. 12 is another perspective view of the guide block of FIG. 10.

The guide mechanism includes two interfitting parts. Referring to FIGS. 10–13, these parts include a guide block 52 which has twelve of guide grooves 54, 56, 58, etc., which are staggered to facilitate entry of multiple tuftstrings into the block. The guide grooves are thus arranged in four groups of three, as best seen in FIGS. 11 and 12. The guide grooves define guide teeth 60 which extend outwardly from a main body portion 62.

Figure 13:
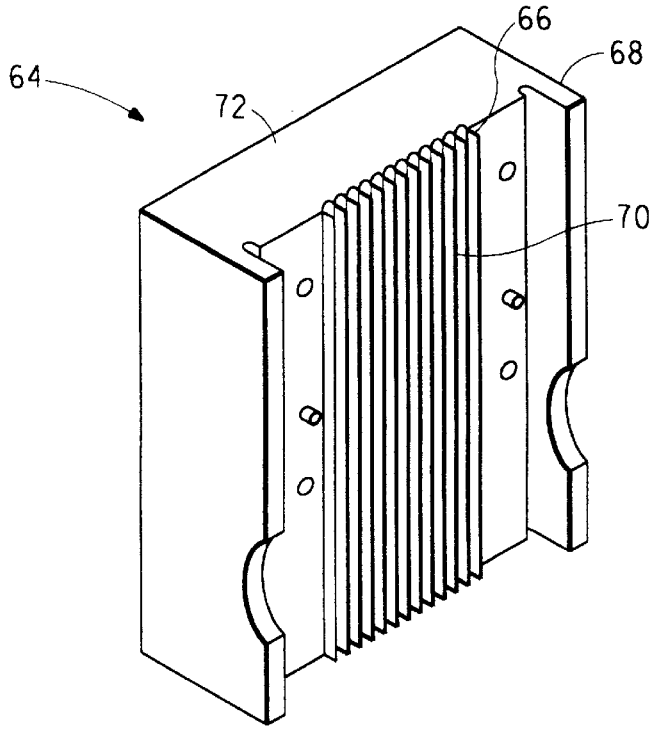
FIG. 13 is a perspective view of a plow block used in the guide mechanism portion of the apparatus of FIGS. 8 and 9.

As seen in FIG. 13, the guide mechanism further includes a plow block 64 which couples to the guide block 52 (seen together in FIGS. 8 and 9). The plow block 64 includes twelve parallel guide blades 66, 68, 70, etc., which extend downwardly from a main body portion 72 of the plow block 64. When assembled with the guide block 52, the guide blades extend between two adjacent teeth 60 of the guide block to form a structure which keeps the tufts separate from the support strands of the tuftstrings, so that when ultrasonic welding occurs, a bond is made between the support strand, or tuft material in the vicinity of the support strand, and the tape when the tape is brought into contact with the tuftstrings.

The guide mechanism 44 is illustrated to carry twelve tuftstrings. However, the guide mechanism can be designed to support any number of tuftstrings, depending on the desired thickness of the pile and the desired through-put speed. For example, for a tape that measures 2.875 inches in width, anywhere between 20–30 tuftstrings could be coupled to the tape. Thus, a guide mechanism having 20–30 separate guides would be desired.

Figure 4:
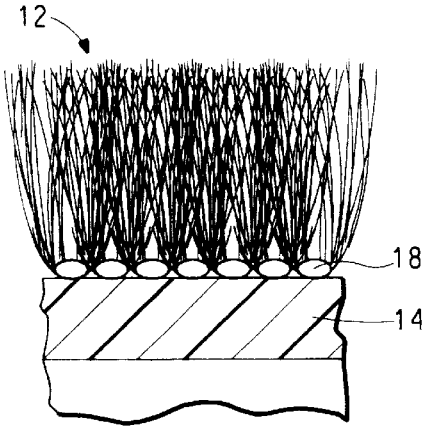
FIG. 4 is an enlarged, partial vertical sectional view of the paint roller of FIG. 1, taken along line III—III of FIG. 2.

When applying tuftstrings directly to the tube, rather than on a support tape, one tuftstring can be wrapped around the tube and bonded thereto, as shown in FIG. 4, or the guide mechanism 46 of the tape-backed embodiments can be used to apply multiple tuftstrings directly to the tube. In this embodiment, a plurality of tuftstrings, guided through the guide block and plow block, are placed in contact with the tube. In one embodiment, the core tube is first coated with a hot melt adhesive or other adhesive system, and the parallel tuftstrings are then wrapped around the tube and bound in place by the adhesive. In this case, between 20–30 tuftstrings are preferred, so that the guide block and plow block would be designed to accommodate the desired number of tuftstrings. Alternatively, two or more guide mechanisms, each accommodating a smaller number of tuftstrings, could be used instead of a single guide mechanism.

Alternative guide mechanisms can be employed, and virtually any mechanical device can be used for that purpose. In general, the guide mechanism should be configured to bring the tuftstrings into contact with either the core tube, or a support tape, in substantially parallel fashion, with the support strands in contact with the tube or tape, and the tuft legs extending upwardly therefrom in an orderly manner.

While the tuftstrings have been described above with reference to a tuftstring having "cut" tufts, tuftstrings using "looped" tufts, as described in the Mokhtar et al. patent could likewise be employed. For further reference to these and other tuftstrings, the aforementioned Mokhtar et al. patent is incorporated herein by reference.

When ultrasonic welding is used to connect the tuftstrings to either the core tube or to the support tape, the support strands of the tuftstrings and/or the tube or tape are made of thermoplastic materials. Those materials are selected to be as compatible as possible in terms of physical and chemical characteristics, such that, if a nylon material is used for the support strand, nylon would be preferred for the support tube. When the support strands are made of a nylon material, the material may be selected from the group consisting of 4 nylon, 6 nylon, 11 nylon, 6,6 nylon, 6,10 nylon, 6,14 nylon, 10,10 nylon and 12,12 nylon and other nylon co-polymers, for example. The support strands can also comprise polyester material such as, for example, polyester 2GT, 3GT, 4GT, etc. and blends of polyester and nylons and acrylics, and dref III and similar materials.

Although the invention has been described with reference to several particular embodiments, it will be understood to those skilled in the art that the invention is capable of a variety of alternative embodiments within the spirit and scope of the appended claims.

What is claimed is:

1. A paint roller comprising:

a core tube having first and second opposite axial ends;

at least one tuftstring spirally positioned about the core tube, the at least one tuftstring having a support strand and a plurality of U-shaped bundles of yarn connected to the support strand; and an adhesive positioned between the at least one tuftstring and the core tube.

2. A paint roller according to claim 1, wherein at least one of the support strand and the yarn comprises a thermoplastic polymeric material.

3. A paint roller according to claim 1, including between 20 and 30 tuftstrings spirally wrapped around the core tube.

4. A paint roller according to claim 1, including between approximately 15 and 45 tuftstrings spirally wrapped around the core tube.

5. A paint roller according to claim 1, wherein the at least one support strand comprises a nylon material selected from 4 nylon, 6 nylon, 11 nylon, 6,6 nylon, 6,10 nylon, 6,14 nylon, 10,10 nylon, 12,12 nylon or other nylon co-polymers.

6. A paint roller comprising:

a core tube having first and second opposite axial ends;

a plurality of tuftstrings spirally wrapped around the core tube, each of said tuftstrings having a support strand and a plurality of discrete U-shaped bundles of yarn connected to the support strand; and an adhesive positioned between the plurality of tuftstrings and the core tube.

7. A paint roller according to claim 6, wherein at least one of the support strand and the yarn comprises a thermoplastic polymeric material.

8. A paint roller comprising:

a core tube having first and second opposite axial ends;

a pile tape spirally wrapped around the core tube, the pile tape including a plurality of discrete tuftstrings bonded to a backing tape, each of said tuftstrings having a support strand and a plurality of discrete U-shaped bundles of yarn connected to the support strand; and an adhesive connecting the pile tape to the core tube.

9. A paint roller according to claim 8, wherein at least one of the support strand and the yarn comprises a thermoplastic polymeric material.

10. A paint roller according to claim 9, including between approximately 15 and 45 tuftstrings connected to the backing tape in parallel thereto.

11. A method of making a paint roller comprising the steps of:

applying an adhesive to a core tube having first and second opposite axial ends; and wrapping at least one tuftstring spirally around the core tube, thereby bonding the at least one tuftstring to the core tube, wherein the at least one tuftstring has a support strand and a plurality of discrete U-shaped bundles of yarn connected to the support strand.

12. A method of making a paint roller comprising the steps of:

forming a tufted tape by attaching a plurality of tuftstrings to a backing tape, each of said tuftstrings having a support strand and a plurality of discrete U-shaped bundles of yarn connected to the support strand;

applying an adhesive to a core tube having first and second opposite axial ends; and wrapping the tufted tape around the core tube, thereby bonding the backing tape to the core tube.

* * * * *